US005682643A

United States Patent [19]

Duffy

[11] Patent Number: 5,682,643

[45] Date of Patent: Nov. 4, 1997

[54] HINGE CONSTRUCTION

[76] Inventor: Philip Duffy, 8 Paradise Rd., Newlands, 7700, Cape Town, South Africa

[21] Appl. No.: 336,253

[22] PCT Filed: Mar. 8, 1994

[86] PCT No.: PCT/EP94/00685

§ 371 Date: Dec. 30, 1994

§ 102(e) Date: Dec. 30, 1994

[87] PCT Pub. No.: WO94/20714

PCT Pub. Date: Sep. 15, 1994

[30] Foreign Application Priority Data

Mar. 8, 1993 [ZA] South Africa ..... 93/1640

[51] Int. Cl.[6] ..... E05D 3/06; E05D 5/00; E05D 7/10

[52] U.S. Cl. ..... 16/265; 16/225; 16/366; 16/382

[58] Field of Search ..... 16/390, 385, 366, 16/380, 225, 271, 272, 382, 383, DIG. 13, 265; 160/135, 235

[56] References Cited

U.S. PATENT DOCUMENTS

| | | | |
|---|---|---|---|
| 212,149 | 2/1879 | Morgeneier | 16/382 |
| 651,145 | 6/1900 | Parker | 16/271 |
| 2,642,018 | 6/1953 | Weeber | 16/366 |
| 2,968,829 | 1/1961 | Meddick | 160/235 |
| 3,096,537 | 7/1963 | Johnson, Jr. | 16/DIG. 13 |
| 3,889,315 | 6/1975 | Stouffer | 160/135 |
| 4,129,163 | 12/1978 | Johnson | 160/135 |
| 4,667,724 | 5/1987 | Dragone | 16/355 |
| 4,670,938 | 6/1987 | Fowlston | 16/385 |
| 5,133,108 | 7/1992 | Esnault | 16/355 |
| 5,150,501 | 9/1992 | Pasternak | 16/272 |

FOREIGN PATENT DOCUMENTS

| | | | |
|---|---|---|---|
| 292380 | 6/1916 | Germany | 16/271 |
| 2160257 | 6/1985 | United Kingdom . | |

*Primary Examiner*—Chuck Y. Mah
*Assistant Examiner*—Donald M. Gurley
*Attorney, Agent, or Firm*—James Ray & Associates

[57] ABSTRACT

A bifold door comprises door panels and a center section, with a hinge construction between each panel and the center section. Each door panel and center section comprises an extruded metal section. First and second hinge elements of synthetic plastic material have key formations which engage with key-ways in the extruded sections. One hinge element has a pintle and the other hinge element has a bore in which the pintle is received.

9 Claims, 3 Drawing Sheets

HINGE CONSTRUCTION

FIELD OF THE INVENTION

This invention relates to a hinge construction. More particularly, but not exclusively, the invention relates to a hinge construction for the type of door used in shower cubicles and referred to as a "bifold" door.

BACKGROUND OF THE INVENTION

Such a type of door comprises two doors panels which are joined to one another along a centre hinge. When the door is closed, the door panels extend at an angle of 180° to one another. When it is opened, the door panels hinge with respect to one another about the hinge, in the manner of a jack-knife, to extend at an angle of 0° or close to 0° with respect to one another.

In conventional doors of this type the hinge is formed by extruded aluminium sections which make metal-to-metal sliding contact with one another. A difficulty experienced with this construction is that it is not possible to coat the metal sections with, for example, the type of coating which is known as powder coating, which is very popular type of coating used to give extruded aluminium a pleasing appearance. The difficulty arises because surfaces which have been so coated do not slide easily on one another and would in any event wear off where the parts make sliding contact, and because the thickness of the coating cannot be controlled accurately enough to provide for the close tolerances that are required in a hinge of this nature. In more traditional hinge constructions gaps are left through which, when the door is in use, water can splash or otherwise leak.

OBJECTS OF THE INVENTION

It is thus an object of the present invention to provide a hinge construction making use of extruded sections but in which metal-to-metal sliding contact between the sections is not required, and which does not leave gaps through which water can splash during use.

BRIEF DESCRIPTION OF THE INVENTION

According to the invention there is provided a hinge construction which comprises first and second extruded sections, a first hinge element having a first key formation and an axially extending pintle, and a second hinge element having a second key formation and an axially extending bore in which the pintle is received, the first extruded section having a first axially extending keyway therein and the second extruded section having a second axially extending keyway therein, the first key formation engaging with the first keyway to connect the first hinge element to the first extruded section, and the second key formation engaging with the second keyway to connect the second hinge element to the second extruded section.

The first and second keyways are preferably formed in the first and second extruded sections during extrusion.

The first and second extruded sections may be of an extruded metal.

The first and second hinge elements may be of a hard-wearing synthetic plastics material. They are preferably in the form of injection moulded parts.

One of the extruded sections may have an axially extending recess therein which is defined in cross-section by a semi-circular wall, the wall of the recess, for part of its circumferential extent, comprising a concentrically curved, thin-walled portion of the respective extruded section, the hinge element which engages with the other extruded section having a concentrically curved slot therein in which the thin-walled portion is receivable.

The thin-walled portion may extend through at least 90° of the circumferential extent of the wall of the recess.

The hinge construction may comprise at least two hinge assemblies each formed by a said first hinge element and a said second hinge element cooperating with the corresponding first hinge element, and a spacer separating the hinge assemblies axially, the spacer having a key formation engaging with the keyway in one of the extruded sections, thereby connecting the spacer to the respective extruded section.

The invention extends to a bifold door which comprises a pair of door panels and a centre section, each door panel being connected to the centre section by means of a hinge construction as defined above.

BRIEF DESCRIPTION OF THE DRAWINGS

The invention will now be described in more detail, by way of example, with reference to the accompanying drawings.

In the drawings.

DESCRIPTION OF THE PREFERRED EMBODIMENT

Figure 1:
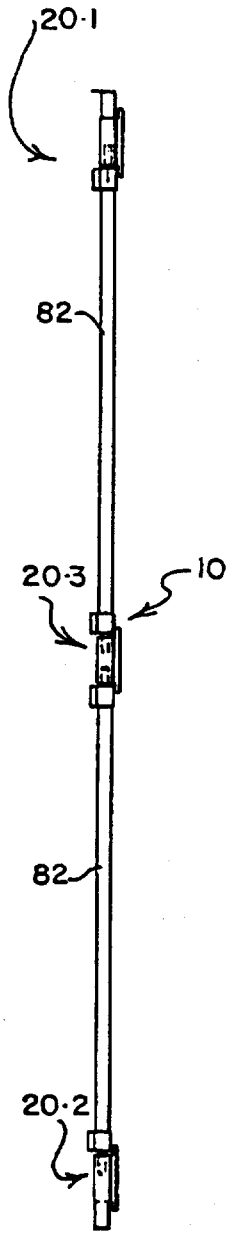
FIG. 1 is an end view (in a horizontal direction) of a bifold shower door having as its centre hinge a hinge construction in accordance with the invention.

Referring now to the drawings in more detail, reference numeral 10 (FIG. 1) generally indicates a bifold door comprising a pair of door panels 12.1 and 12.2 (FIG. 2) and a narrow centre section 14, each of the door panels 12.1 and 12.2 being connected to the centre section by means of a hinge construction 16. Each hinge construction 16 comprises, as a first extruded section, the centre section 14, a second extruded section 18, and three hinge assemblies, namely an upper hinge assembly 20.1, a lower hinge assembly 20.2, and a third hinge assembly 20.3 approximately midway between the hinge assemblies 20.1 and 20.2.

Figure 7:
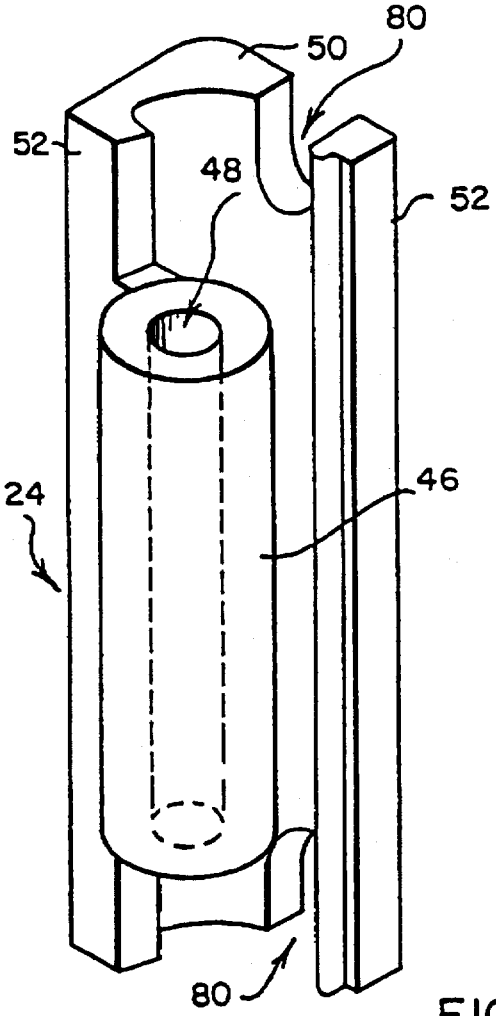
FIG. 7 is pictorial view of one the hinge elements forming part of the hinge construction.

The hinge assembly 20.3 comprises a pair of first hinge elements 22 (FIG. 8) and, between them, a second hinge element 24 (FIG. 7). The first and second hinge assemblies 20.1 and 20.2 are identical to the hinge assembly 20.3, except that they each comprise only one hinge element 22 and one hinge element 24.

Figure 3:
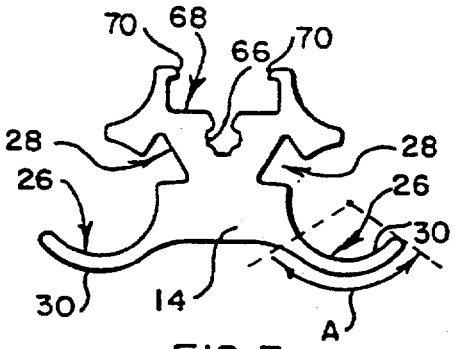
FIG. 3 illustrates the profile of a first extruded section forming part of the hinge construction.

Referring in particular to FIG. 3, the centre section 14 is an aluminium extrusion formed along each opposite longitudinal edge thereof with a semi-circular recess 26. At the bottom of each recess 26 there is a dovetail-shaped keyway 28. The circumferential extent, in cross-section, of each of the recesses 26 is between 180° and 270°. Each recess 26 is defined, for part of its circumferential extent, by a concentrically curved, thin-walled portion 30. The thin-walled portion 30 extends through an angle A which is slightly greater than 90°.

Figure 4:
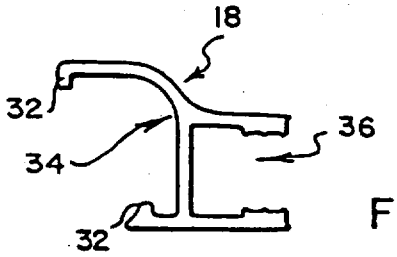
FIG. 4 illustrates the profile of a second extruded section forming part of the hinge construction.

Referring in particular to FIG. 4, each extruded section 18 has, on one side thereof, a pair of incurved lips 32, which define a keyway 34. On the other side, the extruded section 18 has a slot 36 for receiving a glass or acrylic door panel.

Figure 2:
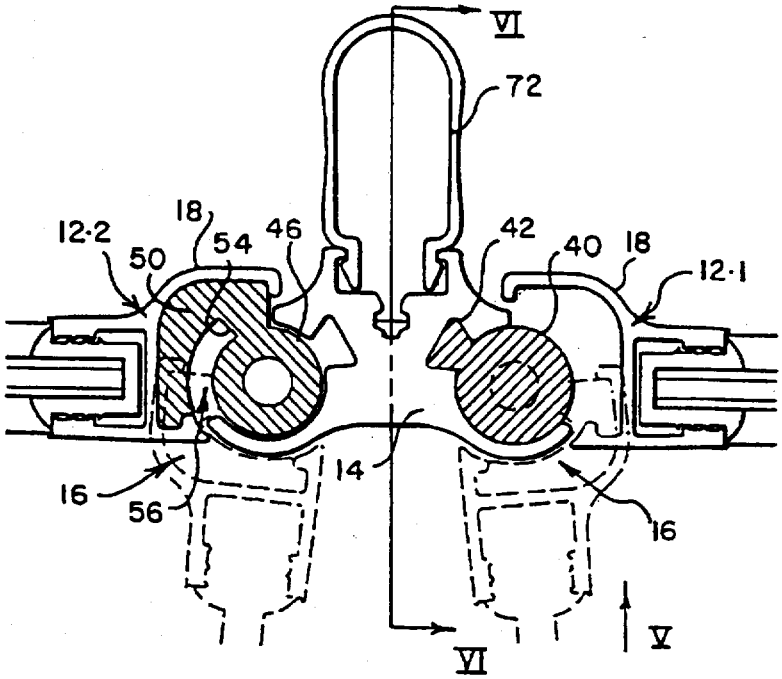
FIG. 2 is a horizontal section of the centre hinge, drawn to a larger scale.
Figure 8:
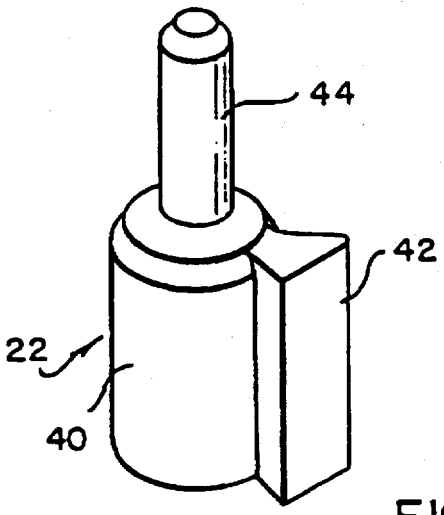
FIG. 8 is a pictorial view of the other hinge element forming part of the hinge construction.

Referring in particular to FIGS. 2, 7, and 8, the first hinge element 22 comprises a cylindrical body 40 having, along one side thereof, a dovetail-shaped key formation 42 and, protruding from one end thereof, an axially extending pintle 44. The second hinge element 24 comprises a cylindrical body 46 having an axially extending bore 48 therein, and a key formation 50. The cross-section of the key formation 50 corresponds to the cross-section of the keyway 34, having shoulders 52 which engage behind the incurved lips 32. The key formation 50 is connected to the cylindrical body 46 via a relatively thin connecting portion 54 (FIG. 2), there being a concentrically curved slot 56 between the cylindrical body 46 and key formation 50.

The hinge elements 22 and 24 are preferably of a hard-wearing plastics material such as nylon.

The cylindrical body 40 of the hinge element 22 and the cylindrical body 46 of the hinge element 24 are each a close sliding fit in the recess 26. When thus in position, the key formation 42 is accommodated in the keyway 28, thereby connecting the hinge element 22 to the centre section 14. In the case of the hinge assembly 20.3, there are two of the hinge 22, elements the two pintles 44 entering respectively from above and below into the bore 48.

Furthermore, the key formation 50 is accommodated in the keyway 34, connecting the hinge element 24 to the extrusion 18.

Figure 10:
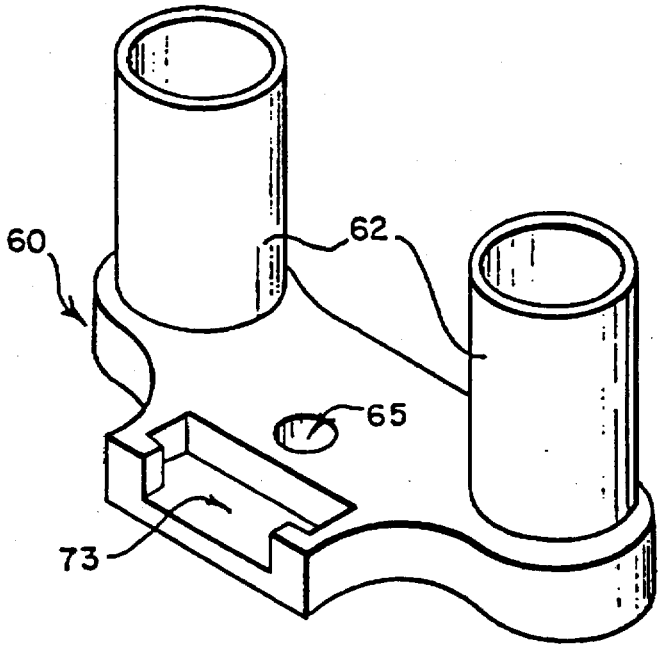
FIG. 10 is a pictorial view of an end cap forming part of the hinge construction.
Figure 6:
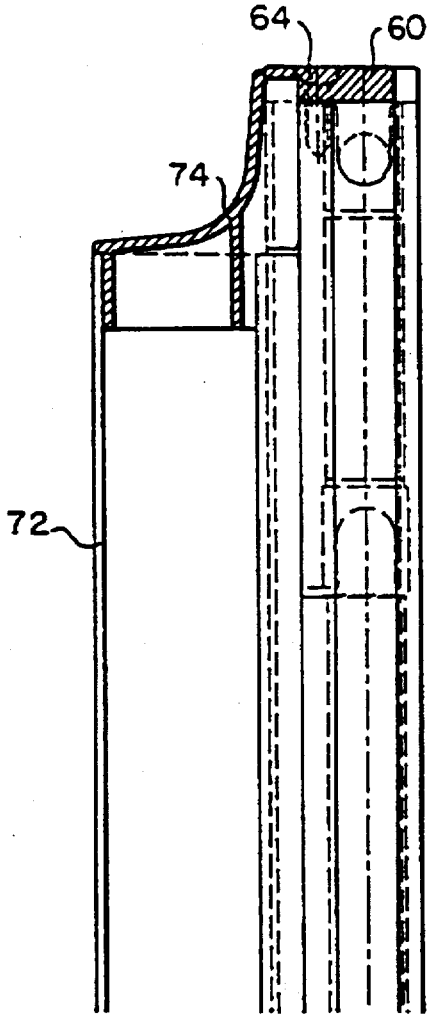
FIG. 6 is section on VI—VI in FIG. 2.

At each opposite end of the centre section 14 there is mounted an end cap 60 (FIGS. 6 and 10). The end cap 60 has a pair of spigot formations 62 which enter end-on into the recesses 26, and is secured in position by means of a screw 64 which passes through an opening 65 in the end cap and engages with a screw port 66 (FIG. 3) formed for this purpose in the extrusion 14.

The extrusion 14 is further provided with a channel 68 (FIG. 3) defined on opposite sides by incurred lips 70. The lips 70 serve to locate a finger-grip element 72 (FIGS. 2 and 6) which is connected to the extruded section 14 for assisting in opening the bifold door. Finials 74 are provided at each opposite end of the finger-grip element 72, there being a recess 73 (FIG. 10) in the respective end cap to assist in locating the finial in position.

The spigot formations 62 butt against the upper or lower face, as the case may be, of the cylindrical body 46 of the upper or lower hinge assembly.

Figure 5:
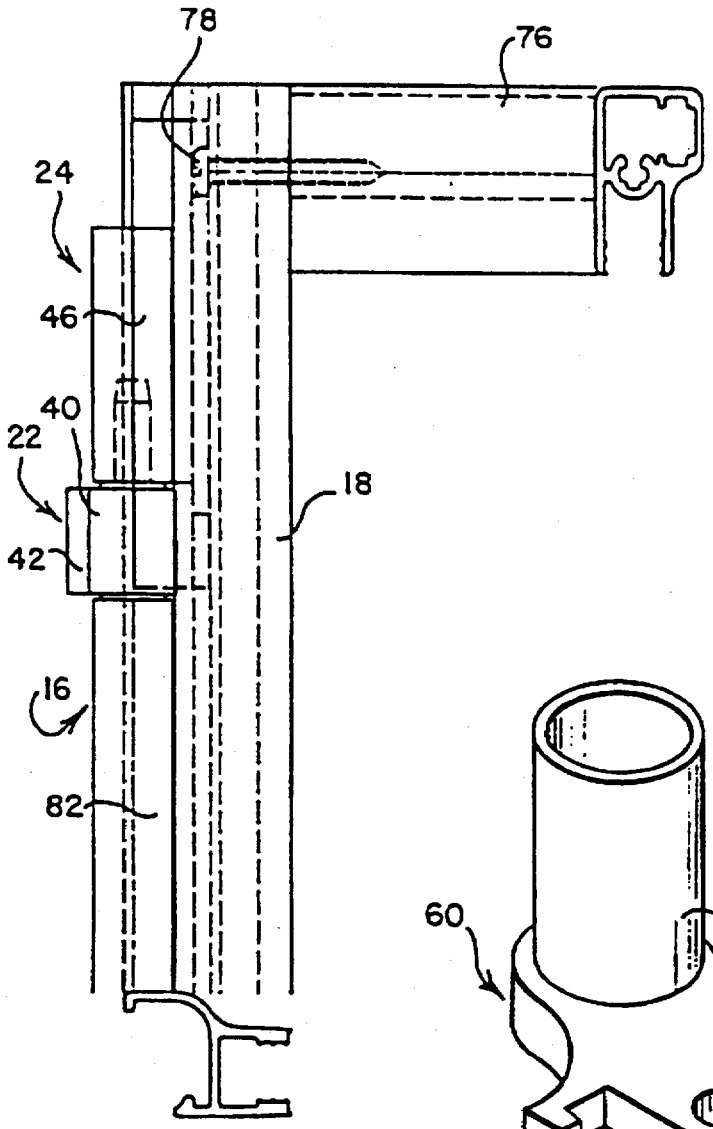
FIG. 5 is a view of one of the door panels in the direction of arrow V in FIG. 2, showing part of the hinge construction.

Each of the door panels 12.1, 12.2 comprises upper and lower rails 76 (FIG. 5) which are secured to the corresponding first extruded sections 18 by means of a screw 78. To accommodate the heads of the screws 78, each of the hinge elements 24 has a recess 80 at each opposite end thereof.

Figure 9:
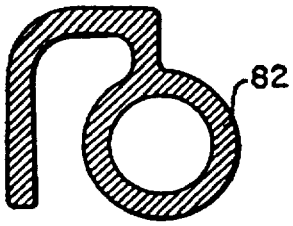
FIG. 9 is a cross-section of a spacer element forming part of the hinge construction.

To keep the hinge assembly 20.3 at the desired position approximately midway between the hinge assemblies 20.1 and 20.2, spacers 82 (FIGS. 1 and 5) are inserted into the recesses 26, to butt at opposite ends thereof against the hinge elements 22. The spacers 82 are preferably of an extruded plastics material, having a cross-section as illustrated in FIG. 9.

It is to be noted that sliding contact between the components that make up the hinge construction, when the door panels hinge with respect to one another, takes place between the synthetic plastics members 22 and 24 and not between extruded aluminium as is the case with existing hinge constructions. This enables the aluminium sections to be coated with, for example, a powder coat which will give them a pleasing finish, without the coating being able to affect the hinge action. The thin-walled sections 30 effectively conceal the components 22, 24, and 82 when the door is viewed in the direction of arrow V shown in FIG. 2.

I claim:

1. A hinge construction which comprises first and second extruded sections, characterized in that the hinge construction further comprises a first hinge element having a first key formation, and an axially extending pintle, and a second hinge element having a second key formation and an axially extending bore in which said pintle of said first hinge element is received, and in that the first extruded section has a first axially extending keyway therein and the second extruded section has a second axially extending keyway therein, the first key formation engaging with the first keyway to connect the first hinge element to the first extruded section, and the second key formation engaging with the second keyway to connect the second hinge element to the second extruded section, one of the extruded sections having an axially extending recess therein which is defined in cross-section by a semi-circular wall, the wall of the recess, for part of its circumferential extent, comprising a concentrically curved, thin-walled portion of the respective extruded section, the hinge element engaging with the other extruded section having a concentrically curved slot therein in which the thin-walled portion is receivable.

2. A hinge construction as claimed in claim 1, characterised in that the first and second keyways (28, 34) are formed in the first and second extruded sections (14, 18) during extrusion.

3. A hinge construction as claimed in claim 1, characterized in that the first and second extruded sections are of extruded metal.

4. A hinge construction as claimed in claim 1, characterised in that the first and second hinge element are of hard-wearing synthetic plastic material.

5. A hinge construction as claimed in claim 4, characterized in that the first and second hinge elements (22, 24) are injection moulded parts.

6. A hinge construction as claimed in claim 1, characterised in that the thin-walled portion (30) extends through at least 90° of the circumferential extent of the wall of the recess.

7. A hinge construction as claimed in claim 1, characterized in that the hinge construction comprises at least two hinge assemblies each formed by a said first hinge element and a said second hinge element cooperating with the corresponding first hinge element, and in that the hinge construction further comprises a spacer separating the hinge assemblies axially, the spacer having a key formation engaging with the keyway in one of the extruded sections, thereby connecting the spacer to the respective extruded section.

8. A bifold door comprising a pair of door panels and a center section, each door panel being connected to the center section by means of a hinge, characterized in that each of the hinges has a construction as claimed in claim 1.

9. A hinge construction which comprises first, second and third extruded sections, a pair of first hinge elements each having a first key formation and an axially extending pintle, and a pair of second hinge elements each having a second key formation and an axially extending bore, the bore of each second hinge element receiving the pintle of one of said first hinge elements, said first and second extruded sections each having an axially extending keyway and the third extruded section having a pair of axially extending keyways, the keyways of the third extruded section being on opposite sides of the third extruded section, the key formations of two of said hinge elements engaging with the keyways of said first and second extruded sections, and the key formations of the remaining two hinge elements engaging with the keyways of said third extruded section, the bores and pintles together providing two parallel hinge axes, the axes being one on each side of the third extruded element.

* * * * *